US006247920B1

(12) United States Patent
Pfeil

(10) Patent No.: US 6,247,920 B1
(45) Date of Patent: Jun. 19, 2001

(54) LIQUID FUEL LIGHTER WITH FIT-UP RIB

(75) Inventor: Bruce Michael Pfeil, Bradford, PA (US)

(73) Assignee: Zippo Manufacturing Company, Bradford, PA (US)

( * ) Notice: Subject to any disclaimer, the term of this patent is extended or adjusted under 35 U.S.C. 154(b) by 0 days.

(21) Appl. No.: 09/662,087

(22) Filed: Sep. 14, 2000

Related U.S. Application Data

(60) Provisional application No. 60/193,026, filed on Mar. 29, 2000.

(51) Int. Cl.[7] ..... F23Q 2/00

(52) U.S. Cl. ..... 431/142; 431/151; 431/152; 431/154; 431/344; 431/277

(58) Field of Search ..... 431/129, 143, 431/142, 133, 277, 151, 152, 137, 138, 154, 144, 344, 126

(56) References Cited

U.S. PATENT DOCUMENTS

| | | | | |
|---|---|---|---|---|
| 1,006,557 | | 10/1911 | Husson . | |
| 2,252,676 | * | 8/1941 | Zaken | 431/143 |
| 2,541,111 | | 2/1951 | Simon et al. | 67/7.1 |
| 2,571,435 | | 10/1951 | Flamm | 67/7.1 |
| 2,633,724 | * | 4/1953 | Anderson | 431/143 |
| 2,692,492 | * | 10/1954 | Hepburn | 431/143 |
| 2,774,234 | | 12/1956 | Blaisdell et al. | 67/4.1 |
| 2,803,123 | * | 8/1957 | Owen | 431/152 |
| 2,810,282 | * | 10/1957 | Mayer, Sr. | 431/142 |
| 3,315,497 | * | 4/1967 | MacDonald | 431/125 |
| 3,353,375 | * | 11/1967 | Bunyard et al. | 431/154 |
| 3,999,937 | | 12/1976 | Lacks | 431/344 |
| 4,011,040 | | 3/1977 | Lacks | 431/344 |
| 4,133,450 | | 1/1979 | Beeson et al. | 220/411 |
| 4,625,861 | | 12/1986 | Krog | 206/234 |
| 4,901,848 | | 2/1990 | Parren | 206/86 |
| 5,082,440 | | 1/1992 | Yamamoto | 431/143 |
| 5,740,905 | | 4/1998 | Kilfoy | 206/87 |
| 5,934,894 | | 8/1999 | Cigler | 431/253 |

FOREIGN PATENT DOCUMENTS

| | | | | |
|---|---|---|---|---|
| 1592729 | * | 7/1981 | (GB) | 431/253 |

* cited by examiner

*Primary Examiner*—Carl D. Price
(74) *Attorney, Agent, or Firm*—Hodgson Russ LLP

(57) ABSTRACT

A refillable pyrophoric lighter having an outer casing with a hinged cover and having an inside unit that is received inside the casing by a frictional fit that is enhanced by at least one transverse rib integrally formed on the outside of the housing of the inside unit.

9 Claims, 1 Drawing Sheet

LIQUID FUEL LIGHTER WITH FIT-UP RIB

This application claims benefit of provisional Application No. 60/193,026 filed Mar. 29, 2000.

FIELD OF INVENTION

The present invention relates generally to lighters, and more particularly to a fit-up rib for improving the fit between the inside unit and the outer case of a lighter.

BACKGROUND OF THE INVENTION

The design of some reusable lighters incorporates a case having a hinged top and a removable insert. The insert contains the functioning mechanism of the lighter. Some lighters have removable inside units for refilling the inside unit with liquid fuel, whereas some lighters have permanent inside units with refill ports on the bottom or side of the lighter for refilling the liquid fuel reservoir in the inside unit. For removable inside units, the optimal fit between the inside unit and the case is when the inside unit can easily be extracted and reinserted by hand, without the use of tools. The fit of the inside unit to the case should not allow the inside unit to move inside the case during normal operation of the lighter. One method for ensuring this fit is to manually spread the sides of the inside unit at the bottom. After spreading the sides of the inside unit, this fit-up operation requires insertion of the inside unit into the case to check for fit. If the fit is not correct, the spreading step is repeated, and the process starts again until the fit is correct.

There have been many designs directed to the fit between the inside unit and the case for lighters.

U.S. Pat. No. 1,006,557 discloses a leaf-type spring (reference "o" in FIG. 1) attached to the inner wall of the outer case for securing the inside unit in the case.

U.S. Pat. No. 2,541,111 also discloses a leaf spring attached to the inside wall of the outer case for positioning and retaining the inside unit.

U.S. Pat. No. 2,571,435 discloses an inner container that is held in position by screws and therefore is not manually removable. Referring to FIG. 1, four structural members hold the corners of the container 2, and a bottom plate 19 that is held in position by a screw 21, holds the container 2 in position.

U.S. Pat. No. 4,133,450 discloses a table lighter arrangement where a disposable lighter is held firmly in the base by upstanding flexible fingers with ribs disposed thereon. When the lighter is inserted the upstanding fingers function as springs to apply a force to the lighter to hold it in position.

U.S. Pat. No. 4,625,861 also discloses a case for a lighter. As shown in FIG. 4, the case is designed to be smaller than the lighter such that a tight fit is achieved.

U.S. Pat. No. 4,901,848 also discloses an outer case for a lighter. The case provides a snug fit as shown in FIG. 5 or a living hinge as shown in FIG. 6.

U.S. Pat. No. 5,740,905 discloses a set of notched flaps at the top of the outer shell that deflect inward when the lighter is inserted and maintain a force against the lighter body to hold it in position.

The above-described patents provide solutions for the fit between the inside unit and the case that are generally expensive, difficult to manufacture, and subject to failure when exposed to repeated removal of the inside unit from the case. What is needed is a relatively simple, durable device for establishing and maintaining the proper fit between the inside unit and the case for a liquid refillable lighter with a removable inside unit.

SUMMARY OF THE INVENTION

The present invention meets the above-described need by providing a rib that is formed in the side or sides of the inside unit shell. The rib is a narrow form that extends horizontally. The rib starts at the side corners of the inside unit shell and gradually increases in thickness toward the center of the shell. The shape may contain a single radius or may comprise a composite of multiple radii and cords. The rib preferably has a varying thickness that blends in at the corners of the inside unit shell and extends out the farthest at the center of the shell where the outer case is most flexible.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 2:
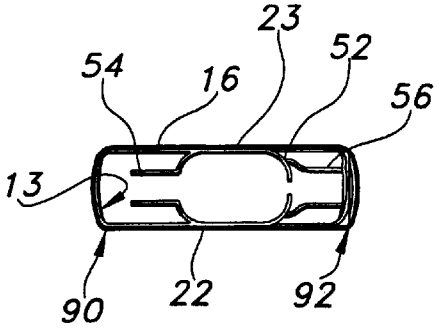
FIG. 2 is a partial top plan view of the lighter illustrating the position of the inside unit with respect to the outer case.
Figure 3:
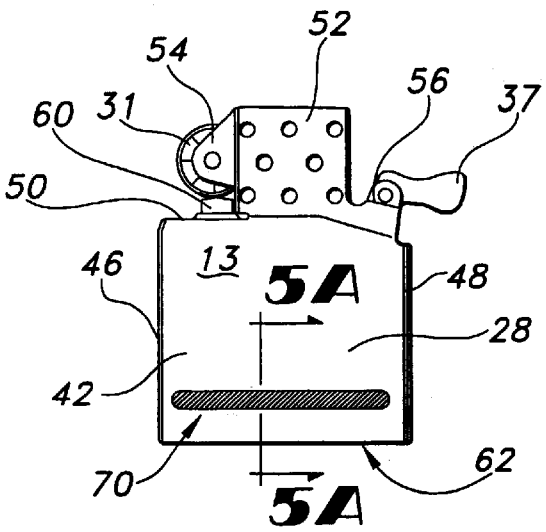
FIG. 3 is a side elevation view of the inside unit of the present invention; and, FIG. 4 is a partial top plan view of the inside unit illustrating a preferred embodiment of the fit-up rib of the present invention.
Figure 1:
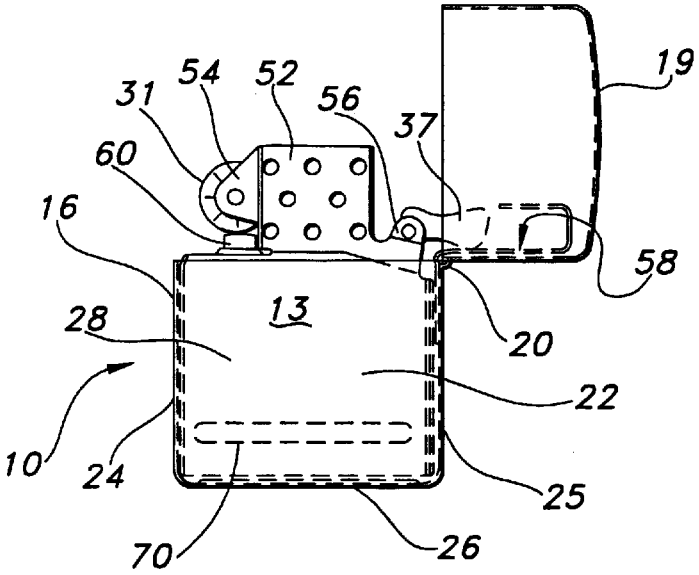
FIG. 1 is a side elevation view of a lighter of the present invention.
Figure 4:
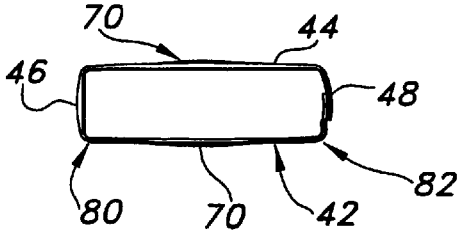

Referring generally to FIGS. 1–4, a lighter 10 of the present invention includes an inside unit body 13 and an outer case 16. The outer case 16 has a cover 19 attached by means of a hinge 20. The inside unit body 13 and the outer case 16 are both hollow and formed out of sheet metal. The outer case 16 has two side walls 22, 23; two end walls 24, 25; and a bottom wall 26. The case is open at the top. The hinge 20 attaches the cover 19 to the case 16 at the top of end wall 25.

The inside unit 13 is preferably formed as a sheet metal casing 28 with an open lower end 62, and is provided with a wick (not shown) that extends downwardly in a central location to the lower end of the body 13. A filling of suitable absorbent material (not shown), which may be of cotton, surrounds the wick and fills the space within the metal casing 28.

The inside unit 13 carries as part of its mechanism a striker wheel 31, a flint 60, and a spring biased cover-control lever 37. The inside unit 13 has a hollow housing 28 defined by a first side wall 42 disposed in spaced apart relation from a second side wall 44. A first end wall 46 is disposed in spaced apart relation to a second end wall 48 and a top plate 50. The first and second side walls 42, 44 extend above the top plate 50 and are formed to provide a wind screen 52 and a front and rear pair of lugs 54, 56. The inside unit 13 has a lever 37 mounted between the rear pair of lugs 56 and a spring-biased plunger (not shown) for biasing the lever 37 against the cross member 58 when the cover 19 is closed. The inside unit 13 has a flint wheel 31 mounted in the front pair of lugs 54. The flint wheel 31 is disposed adjacent to the flint 60 and to the wick extending from a fuel reservoir defined inside the housing 28. The workings and arrangement of these parts are disclosed in greater detail in U.S. Pat. No. 2,032,695, which is incorporated herein by reference.

The inside unit body 13 is disposed inside the outer case 16 by means of a snug frictional fit. The frictional fit has to be snug enough so that the inside unit 13 does not move inside the outer case 16, yet is loose enough such that it can be removed for refilling. In order to refill the lighter 10, the inside unit 13 is removed and lighter fuel is added through the bottom of the inside unit 13. A resilient barrier (not shown) covering the absorbent cotton material is removed manually, and the lighter fuel is added to the absorbent cotton material until a charge of fluid has been delivered. Next, the inside unit 13 is frictionally fit back into the outer case 16 such that the open end 62 of the inside unit 13 slides down into engagement with the closed bottom of the outer case 16 to form a fuel storage area that is sealed against leaking by the snug fit.

The optimal fit between the inside unit 13 and the case 16 is when the unit 13 can be easily extracted and reinserted by hand, without the use of tools. The proper fit of the inside unit 13 to the case 16 should not allow the inside unit 13 to move inside the case 16 under normal operation of the lighter 10.

In order to provide for a snug frictional fit, the inside unit 13 of the present invention is provided with a horizontal form or rib 70 that preferably extends across the entire width of the inside unit 13. The rib 70 is integrally formed in the sheet metal housing of the inside unit 13 such that the inside unit 13 fits snugly into the outer case 16. The horizontal rib 70 extends from one corner 80 where a side wall 22 meets an end wall 24 to the opposite corner 82 where the side wall 22 meets the opposite end wall 25.

The rib 70 is preferably narrower adjacent to the corners. The corners 90, 92 of the outer case 16 correspond to the corners 80, 82 of the inside unit 13 when the inside unit 13 is inserted into the case 16. The construction of the case 16 is strongest and has the least amount of flexibility in the corners 90, 92 where the side wall 22 meets the end walls 24, 25. The outer case 16 becomes more flexible toward the center of the side walls 22 where the maximum flexibility is provided.

Accordingly, the thickness of the rib 70 preferably varies roughly according to the flexibility of the side wall 22. In the corners 90, 92 where the outer case 16 is relatively rigid, the rib 70 is provided with its minimum thickness. At the center of the side wall 22 where the case 16 is most flexible, the rib 70 is provided with its maximum thickness.

Figure 5B:
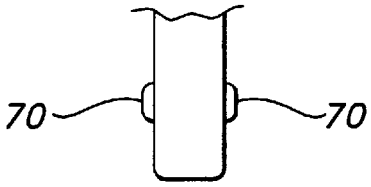
FIG. 5A is a cross-sectional view taken along line 5A—5A of FIG. 3; and, FIG. 5B is an alternate embodiment of the rib of the present invention.
Figure 5A:
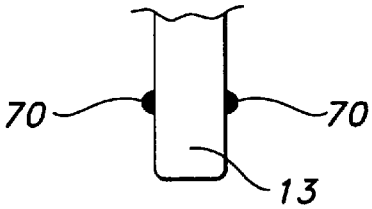

The cross-sectional shape of the rib 70 may take several forms including a single radius (FIG. 5A) or multiple radii and/or cords (FIG. 5B).

The rib 70 provides several advantages including minimizing single point contact between the inside unit 13 and the case 16 both during removal and insertion of the inside unit 13 and during normal use. By increasing the contact area between the sides of the inside unit 13 and the case 16, the rib 70 distributes the load over a larger area and therefore provides better wear characteristics. The rib 70 also provides a more consistent fit between the inside unit 13 and the case 16.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A lighter comprising:

a hollow casing having a first side wall disposed in spaced apart relation to a second side wall, a first end wall disposed in spaced apart relation to a second end wall, an open top, and a bottom wall connected to the side walls and end walls;

a cover pivotally attached to the casing by a hinge disposed on the first end wall adjacent to the open top; and, an inside unit having at least one transverse rib disposed across a majority of the width of at least one of the side walls and integrally formed therein, the inside unit sized such that the transverse rib fits snugly inside the casing so that the inside unit is held in position by a frictional fit yet can be removed from the casing by hand, the transverse rib positioned such that it is near the bottom wall when the inside unit is inserted into the casing.

2. The lighter of claim 1, wherein the transverse rib is disposed substantially parallel to the bottom wall of the casing.

3. The lighter of claim 1, wherein a cross-section taken along a longitudinal axis of the transverse rib is defined by a curve having a single radius.

4. The lighter of claim 1, wherein a cross-section taken along longitudinal axis of the transverse rib is defined by a curve having multiple radii.

5. The lighter of claim 1, wherein the transverse rib extends from a first corner where the first side wall connects to the first end wall to a second corner where the first side wall connects to the second end wall.

6. The lighter of claim 5, wherein the transverse rib has a first cross-sectional area adjacent the corner and has a second cross-sectional area adjacent a midportion of the transverse rib, the second cross-sectional area being larger than the first cross-sectional area.

7. The lighter of claim 1, wherein the first side wall and the second side wall have a transverse rib disposed thereon.

8. A pyrophoric lighter, comprising:

a hollow casing having a first side wall disposed in spaced apart relation to a second side wall, a first end wall disposed in spaced apart relation to a second end wall, an open top, and a bottom wall connected to the side walls and end walls;

a cover having a pair of spaced apart side walls and a pair of spaced apart end walls, the cover pivotally attached to the casing by a hinge connected to the cover and to the first end wall of the case adjacent to the open top, the cover having a cross member disposed in spaced apart relation to the end wall of the cover; and, an inside unit having a hollow housing defined by a first side wall disposed in spaced apart relation from a second side wall, a first end wall disposed in spaced apart relation to a second end wall and a top plate, the first and second side walls extending above the top plate and being formed to provide a wind screen and a front and rear pair of lugs, the inside unit having a lever mounted between the rear pair of lugs and a spring-biased plunger for biasing the lever against the cross member when the cover is closed, the inside unit having a flint wheel mounted in the front pair of lugs, the flint wheel disposed adjacent to the flint and to a wick extending from a fuel reservoir defined inside the housing, the inside unit having at least one transverse rib disposed across a majority of the width of at least one of the side walls and integrally formed therein, the inside unit sized such that the transverse rib fits snugly inside the casing so that the inside unit is held in position by a frictional fit yet can be removed from the casing by hand, the transverse rib positioned such that it is near the bottom wall when the inside unit is inserted into the casing.

9. A method of manufacturing a lighter, comprising the steps of:

providing a hollow casing having a first side wall disposed in spaced apart relation to a second side wall, a first end wall disposed in spaced apart relation to a second end wall, an open top, and a bottom wall connected to the side walls and end walls;

providing a cover pivotally attached to the casing by a hinge disposed on the first end wall adjacent to the open top;

providing an inside unit having a hollow housing defined by a first side wall disposed in spaced apart relation from a second side wall, a first end wall disposed in spaced apart relation to a second end wall and a top plate, the first and second side walls extending above the top plate and being formed to provide a wind screen and a front and rear pair of lugs, the inside unit having a lever mounted between the rear pair of lugs and a spring-biased plunger for biasing the lever against the cross member when the cover is closed, the inside unit having a flint wheel mounted in the front pair of lugs, the flint wheel disposed adjacent to the flint and to a wick extending from a fuel reservoir defined inside the housing; and, integrally forming at least one transverse rib disposed across a majority of the width of at least one of the side walls and integrally formed therein, the inside unit sized such that the transverse rib fits snugly inside the casing so that the inside unit is held in position by a frictional fit yet can be removed from the casing by hand, the transverse rib positioned such that it is near the bottom wall when the inside unit is inserted into the casing.

* * * * *